US005233821A

United States Patent [19]

Weber, Jr. et al.

[11] Patent Number: 5,233,821

[45] Date of Patent: Aug. 10, 1993

[54] PROTECTIVE GARMENT CONTAINING POLYBENZAZOLE

[75] Inventors: Charles P. Weber, Jr., Monroe, N.C.; David A. Dalman, Midland, Mich.

[73] Assignee: The Dow Chemical Company, Midland, Mich.

[21] Appl. No.: 660,497

[22] Filed: Feb. 25, 1991

[51] Int. Cl.[5] ..... A41D 13/02; A41D 13/04; A41D 13/10; D02G 3/02; D02G 3/36

[52] U.S. Cl. ..... 57/224; 2/2.5; 2/7; 2/8; 2/16; 2/48; 2/81; 2/93; 2/102; 2/167; 2/239; 2/2.11; 2/2.14; 2/161.6; 5/483; 57/904; 428/229; 428/377; 428/911; 428/920

[58] Field of Search ..... 428/229, 377, 911, 920; 2/16, 48, 49 R, 93, 161 R, 167, 239, 2.1 A, 2.5, 81, 102; 5/483; 57/224, 904

[56] References Cited

U.S. PATENT DOCUMENTS

| | | | |
|---|---|---|---|
| 3,449,296 | 6/1969 | Angelo et al. | 528/26 |
| 4,004,295 | 1/1977 | Byrnes | 2/161 R |
| 4,384,449 | 5/1983 | Byrnes et al. | 57/10 |
| 4,470,251 | 9/1984 | Bettcher | 57/230 |
| 4,533,693 | 8/1985 | Wolfe et al. | 524/417 |
| 4,777,789 | 10/1988 | Kolmes et al. | 57/210 |
| 4,838,017 | 6/1989 | Kolmes et al. | 57/210 |
| 4,856,110 | 8/1989 | Giesick | 2/22 |
| 4,886,691 | 12/1989 | Wincklhofer | 428/229 |
| 4,912,781 | 4/1990 | Robins | 2/167 |
| 4,918,912 | 4/1990 | Warner | 57/255 |
| 4,936,085 | 6/1990 | Kolmes et al. | 57/229 |
| 5,021,283 | 6/1991 | Takenaka et al. | 428/118 |
| 5,070,540 | 12/1991 | Bettcher et al. | 428/229 |
| 5,087,499 | 2/1992 | Sullivan | 428/229 |
| 5,091,243 | 2/1992 | Tolbert et al. | 428/229 |

OTHER PUBLICATIONS

*Kevlar® aramid Protective Apparel,* Product Literature available from E. I. Du Pont de Nemours & Co.

*New Levels of Personal Protection . . . Devlar® aramid,* Product Literature available from E. I. Du Pont de Nemours & Co.

*Primary Examiner*—James C. Cannon

[57] ABSTRACT

Fabrics containing polybenzazole fibers have high cut-resistance, and can be used to make cut-resistant and flame-resistant garments.

33 Claims, No Drawings

PROTECTIVE GARMENT CONTAINING POLYBENZAZOLE

BACKGROUND OF THE INVENTION

The present invention relates to the art of fabrics and garments useful for protection against fire and/or cutting.

Protective garments are known for many purposes. Cut-resistant gloves, chaps, vests, aprons, coats and socks are used to protect meat-cutters, chain saw operators, ice skaters and others who work regularly with sharp blades from being cut. Cut-resistant garments and fabric typically contain leather, metal wire, metal links, cut-resistant polymer fibers such as aramid or gel-spun polyethylene, or combinations of those materials with each other and/or with conventional fabric materials. For instance, gloves are commonly made of Kevlar TM aramid fibers either alone or in combination with metal wire.

Fire resistant garments and fabric, such as coats, blankets and other clothing, are used by fire fighters and others who are regularly exposed to flame. Known fireresistant fabrics are frequently made of self-extinguishing polymer fibers, such as Nomex TM aramid fibers.

The existing materials used in protective fabric and garments have several deficiencies. Cut-resistant garments are frequently uncomfortable. They require large quantities of out-resistant fiber that is expensive and reduces the comfort of the garment. If a more cut-resistant fiber were available, then cut resistant garments containing less cut resistant fiber could be made. It would also be desirable to provide a cut-resistant fiber that is flame resistant.

SUMMARY OF THE INVENTION

One aspect of the present invention is a protective garment that comprises a plurality of polybenzoxazole or polybenzothiazole polymer fibers, selected such that the garment is cut-resistant and/or flame resistant.

A second aspect of the present invention is a method to protect a person or object from fire or sharp objects, comprising the step of interposing a fabric that comprises a plurality of polybenzoxazole or polybenzothiazole polymer fibers, selected such that the fabric is cut-resistant and/or flame resistant, between the person or object to be protected and the fire or sharp object.

A third aspect of the present invention is a composite fiber comprising:

(1) a core containing one or more fibers; and (2) at least one wrapping fiber wrapped around said core.

wherein either the wrapping fiber or the core contains a polybenzoxazole or polybenzothiazole fiber.

Garments of the present invention and fabric containing polybenzazole polymers may be used to protect a person or object against sharp objects and or flame.

DETAILED DESCRIPTION OF THE INVENTION

The present invention uses a fabric or garment that contains a plurality of fibers containing polybenzoxazole (PGO) or polybenzothiazole (PBT) or copolymers thereof. PBO, PBT and random, sequential and block copolymers of PBO and PBT are described in references such as Wolfe et al., *Liquid Crystalline Polymer Compositions, Process and Products*, U.S. Pat. No. 4,703,103 (Oct. 27, 1987); Wolfe et al., *Liquid Crystalline Polymer Compositions, Process and Products*, U.S. Pat. No. 4,533,692 (Aug. 6, 1985); Wolfe et al., *Liquid Crystalline Poly(2,6-Benzothiazole) Compositions, Process and Products*, U.S. Pat. No. 4,533,724 (Aug. 6, 1985); Wolfe, *Liquid Crystalline Polymer Compositions, Process and Products*, U.S. Pat. No. 4,533,693 (Aug. 6, 1985); Evers, *Thermoxadatively Stable Articulated p-Benzobisoxazole and p-Benzobisthiazole Polymers*, U.S. Pat. No. 4,359,567 (Nov. 16, 1982); Tsai et al., *Method for Making Heterocyclic Block Copolymer*, U.S. Pat. No. 4,578,432 (Mar. 25, 1986); 11 Encyl. Poly. Sci. & Eng., *Polybenzothiazoles and Polybenzoxazoles*, 601 (J. Wiley & Sons 1988) and W. W. Adams et al., *The Materials Science and Engineering of Rigid-Rod Polymers* (Materials Research Society 1989), which are incorporated herein by reference.

The polymer may contain AB-mer units, as represented in Formula 1(a), and/or AA/BB-mer units, as represented in Formula 1(b)

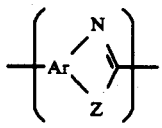

1(a) AB

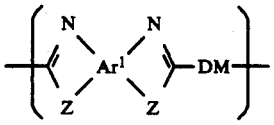

1(b) AA/BB wherein:

Each Ar represents an aromatic group. The aromatic group may be heterocyclic, such as a pyridinylene group, but it is preferably carbocyclic. The aromatic group may be a fused or unfused polycyclic system, but is preferably a single six-membered ring. Size is not critical, but the aromatic group preferably contains no more than about 18 carbon atoms, more preferably no more than about 12 carbon atoms and most preferably no more than about 6 carbon atoms. Examples of suitable aromatic groups include phenylene moieties, tolylene moieties, biphenylene moieties and bis-phenylene ether moieties. $Ar^1$ in AA/BB-mer units is preferably a 1,2,4,5-phenylene moiety or an analog thereof. Ar in AB-mer units is preferably a 1,3,4-phenylene moiety or an analog thereof.

Each Z is independently an oxygen or a sulfur atom.

Each DM is independently a bond or a divalent organic moiety that does not interfere with the synthesis, fabrication or use of the polymer. The divalent organic moiety may contain an aliphatic group, which preferably has no more than about 12 carbon atoms, but the divalent organic moiety is preferably an aromatic group (Ar) as previously described. It is most preferably a 1,4-phenylene moiety or an analog thereof.

The nitrogen atom and the Z moiety in each azole ring are bonded to adjacent carbon atoms in the aromatic group, such that a five-membered azole ring fused with the aromatic group is formed.

The azole rings in AA/BB-mer units may be in cis- or trans-position with respect to each other, as illustrated in 11 Ency. Poly. Sci. & Eng., supra, at 602, which is incorporated herein by reference.

The polymer preferably consists essentially of either AB-PBZ mer units or AA/BB-PBZ mer units, and more preferably consists essentially of AA/BB-PBZ mer units. The polybenzazole polymer may be rigid rod, semi-rigid rod or flexible coil. It is preferably rigid rod in the case of an AA/BB-PBZ polymer or semi-rigid in the case of an AB-PBZ polymer. Azole rings within the polymer are preferably oxazole rings (Z=O). Preferred mer units are illustrated in Formulae 2(a)–(g). The polymer more preferably consists essentially of mer units selected from those illustrated in 2(a)–(g), and most preferably consists essentially of a number of identical units selected from those illustrated in 2(a)–(c).

(a)

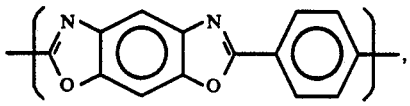

(b)

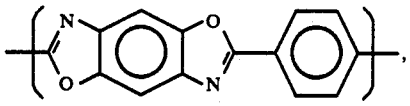

(c)

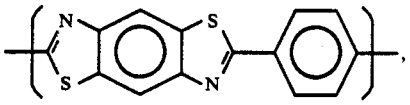

(d)

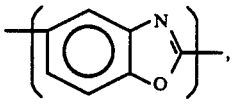

(e)

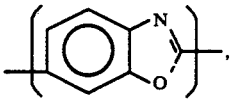

(f)

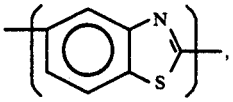

and (g)

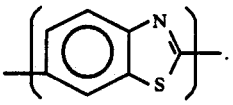

Each polymer preferably contains on average at least about 25 mer units, more preferably at least about 50 mer units and most preferably at least about 100 mer units. The intrinsic viscosity of rigid AA/BB-PBZ polymers in methanesulfonic acid at 25° C. is preferably at least about 10 dL/g, more preferably at least about 15 dL/g and most preferably at least about 20 dL/g. For some purposes, an intrinsic viscosity of at least about 25 dL/g or 30 dL/g may be best. Intrinsic viscosity of 60 dL/g or higher is possible, but the intrinsic viscosity is preferably no more than about 40 dL/g. The intrinsic viscosity of semi-rigid AB-PBZ polymers is preferably at least about 5 dL/g, more preferably at least about 10 dL/g and most preferably at least about 15 dL/g.

The polymer or copolymer is dissolved in a solvent to form a solution or dope. Some polybenzoxazole and polybenzothiazole polymers are soluble in cresol, but the solvent is preferably an acid capable of dissolving the polymer. The acid is preferably non-oxidizing. Examples of suitable acids include polyphosporic acid, methanesulfonic acid and sulfuric acid and mixtures of those acids. The acid is preferably polyphosphoric acid and/or methanesulfonic acid, and is more preferably polyphosphoric acid. The fiber should be chosen so that its properties do not degrade upon contact with the acid.

The dope should contain a high enough concentration of polymer for the polymer to coagulate to form a solid article. When the polymer is rigid or semi-rigid, then the concentration of polymer in the dope is preferably high enough to provide a liquid crystalline dope. The concentration of the polymer is preferably at least about 7 weight percent, more preferably at least about 10 weight percent and most preferably at least about 14 weight percent. The maximum concentration is limited primarily by practical factors, such as polymer solubility and dope viscosity. The concentration of polymer is seldom more than 30 weight percent, and usually no more than about 20 weight percent.

Suitable polymers or copolymers and dopes can be synthesized by known procedures, such as those described in Wolfe et al., U.S. Pat. Nos. 4,533,693 (Aug. 6, 1985); Sybert et al., 4,772,678 (Sep. 20, 1988): Harris, 4,847,350 (Jul. 11, 1989); and Ledbetter et al., "An Integrated Laboratory Process for Preparing Rigid Rod Fibers from the Monomers," *The Materials Science and Engineering of Rigid-Rod Polymers* at 253–64 (Materials Res. Soc. 1989), which are incorporated herein by reference. In summary, suitable monomers (AA-monomers and BB-monomers or AB-monomers) are reacted in a solution of nonoxidizing and dehydrating acid under nonoxidizing atmosphere with vigorous mixing and high shear at a temperature that is increased in step-wise or ramped fashion from no more than about 120° C. to at least about 190° C. Examples of suitable AA-monomers include terephthalic acid and analogs thereof. Examples of suitable BB-monomers include 4,6-diaminoresorcinol, 2,5-diaminohydroquinone, 2,5-diamino-1,4-dithiobenzene and analogs thereof, typically stored as acid salts. Examples of suitable AB-monomers include 3-amino-4-hydroxybenzoic acid, -hydroxy-4-aminobenzoic acid, 3-amino-4-thiobenzoic acid, 3-thio-4-aminobenzoic acid and analogs thereof, typically stored as acid salts.

The dope is spun into fibers by known dry jet-wet spin techniques in which the dope is drawn through a spinneret, across an air gap and into a coagulation bath. Fiber spinning and coagulation techniques are described in greater detail in Tan, U.S. Pat. Nos. 4,263,245 (Apr. 21, 1981): Wolfe et al., 4,533,693 (Aug. 6, 1985): and Adams et al., *The Materials Science and Engineering of Rigid Rod Polymers*, 247–49 and 259–60 (Materials Research Society 1989), which is incorporated herein by reference. Each fiber preferably has an average diameter of no more than about 50 μm and more preferably no more than about 25 μm. Minimum fiber diameter is limited by practical ability to spin. Average fiber diameters are seldom less than about 1 μm and usually at least about 7 μm. Smaller denier filaments ordinarily provide better dexterity, but cost more. The average tensile strength of the fiber is preferably at least about 1 GPa, more preferably at least about 1.75 GPa, more highly preferably at least about 2 75 GPa, and most preferably at least about 4.10 GPa.

The fibers may be heat treated, but they preferably are not. Heat treatment ordinarily increases the stiffness of the fibers, and greater stiffness is not usually desirable in garments.

Fibers are usually collected into yarns prior to making a fabric. Yarns may either be from staple or from continuous filaments. For a staple-based yarn, the fiber is cut or stretch-broken into short segments, such as about 1 inch to 6 inches in length. The short segments are spun according to ordinary yarn spinning procedures to obtain a yarn suitable for further processing. Continuous filament yarn contains a number of continuous filaments that are held together by known means, such as twisting, entanglement or application of a finish. A typical twist for a twisted yarn is about one or two twists per inch, although a greater or lesser number may also be used.

The optimum denier of the yarn varies depending upon the desired use and price of the fabric. For most purposes, the yarn is preferably at least about 50 denier, more preferably at least about 200 denier and most preferably at least about 500 denier. For most purposes, the yarn is preferably at most about 2000 denier, more preferably at most about 1500 denier and most preferably no more than about 1000 denier.

The yarn is preferably lubricated with a knitting oil, such as mineral oil. The yarn may be made into a fabric or article of clothing by known methods, such as knitting, weaving, braiding or forming into non-woven fabric. For instance, the yarn may be knitted on conventional knitting equipment useful for knitting other high-strength fibers, such as aramid fibers. The polybenzazole fiber yarn may be too cut resistant for cutting tools which are standard on commercial equipment. It may be necessary to improve the cutting equipment or cut by hand. Knitting techniques are well-known in the art. For instance, the polybenzazole-containing fiber or yarn may be substituted for aramid fibers in knitted items as described in Byrnes, U.S. Pat. Nos. 3,883,898 (May 20, 1975) and/or Byrnes, 3,953,893 (May 4, 1976). Yarn that is woven into a plain piece of fabric may be cut and sewn to make garments according to known procedures.

Numerous variations are possible. For instance, the polybenzazole-containing fiber may contain a mixture polybenzoxazole polymer, polybenzothiazole polymer and another polymer (such as poly(aromatic ether ketone)) that is dissolved in the dope with the polybenzazole polymer and is spun and coagulated to form a mixed fiber. Likewise the polybenzazole polymer may be a random or block copolymer of polybenzazole and another polymer, such as polyamide or poly(aromatic ether ketone), as described in Harris et al., PCT Publication WO 90/03995 (published Apr. 19, 1990), which is incorporated herein by reference.

The polybenzazole-containing fiber or yarn may be part of a composite fiber, so that the garment or fabric is knit or woven from the composite fiber. Composite fibers typically comprise one or more core fibers that are wrapped by one or more wrap fibers. The polybenzazole-containing fibers used in the present invention may be used in the core or the wrap or both, but are preferably used only in the core.

The core of the composite fiber preferably contains at least one cut-resistant fiber, such as polybenzazole-containing fiber, an aramid fiber (such as Kevlar TM fiber), a gel-spun polyethylene fiber (such as Spectra TM fiber), a glass fiber or a steel fiber. It may consist essentially of the polybenzazole-containing fiber, but it more preferably further contains an aramid fiber (such as Kevlar TM fiber), a gel-spun polyethylene fiber (such as Spectra TM fiber), a glass fiber or a steel fiber, as well as the polybenzazole fiber. The core most preferably contains both polybenzazole-containing fiber and steel fiber. The core fibers are longitudinally positioned, i.e. essentially following the major axis of the fiber. When the core contains more than one fiber, the fibers may be parallel or one or more core fibers may be wrapped around one or more core fibers. The entire core is wrapped with a wrap fiber.

Wrap fibers are preferably more conventional wrap fibers, such as cotton, polyester, nylon or rayon. The most preferred wrap fibers are polyester and nylon. The core is preferably wrapped twice, once clockwise and once counterclockwise, so that the tensions of the two wrappings at least partially offset to prevent twisting. The optimum ratio of wrap fiber to core fiber varies depending upon the desired use of the garment. The composite fiber may contain from 1 to 99 percent wrap fiber, but ordinarily contains at least about 30 percent wrap fiber and preferably contains at least about 50 percent wrap. For most purposes, the composite fiber preferably contains no more than about 95 percent wrap and more preferably contains no more than about 90 percent wrap. All percentages are by weight.

A fiber, composite fiber or yarn containing polybenzazole polymer may be knit, braided, woven or formed into a nonwoven fabric by itself, or it may be knit, braided, woven or formed into nonwoven fabric with other fibers or yarns. For instance, the polybenzazole-containing fiber or yarn may be woven with conventional clothing fibers, such as cotton, polyester, nylon or rayon, to provide a woven garment that is more cut-resistant than garments woven entirely from the conventional fibers and more comfortable than garments woven entirely from the polybenzazole-containing fiber or yarn.

The following U.S. Patents, which are incorporated herein by reference, describe garments and/or fabrics containing commingled or composite fibers and/or two types of fibers woven together: Byrnes, U.S. Pat. Nos. 4,004,295 (Jan. 25, 1977): Byrnes et al., 4,384,449 (May 24, 1983); Bettcher, 4,470,251 (Sep. 11, 1984): Kolmes, 4,777,789 (Oct. 18, 1988); Kolmes, 4,838,017 (Jun. 13, 1989): Giesick, 4,856,110 (Aug. 15, 1989): Robins, 4,912,781 (Apr. 3, 1990): Warner, 4,918,912 (Apr. 24, 1990) and Kolmes, 4,936,085 (Jun. 26, 1990), which are incorporated herein by reference. Polybenzazole-containing fibers and yarns can be used in similar fabrics along with, or in the place of, the aramid fibers and other cut-resistant fibers described in those patents, to make fabrics or garments of the present invention.

The polybenzazole-containing fiber or yarn can be made into almost any type of garment for use by persons who might be exposed to flame or sharp objects Garments within the scope or the present invention may include, for example: gloves, socks, chaps, vests, overalls, coats (such as fireman's coats), fire blankets, racing suits, military pilot's flight clothing, or clothing and pressure suits for astronauts.

The polybenzazole polymer and the percent of polybenzazole-containing fiber in the garment should be selected to provide properties suitable for the desired use of the garment. The polymer should be selected to provide adequate cut- and/or fire-resistance. The preferred polymers previously described are both highly cut-resistant and essentially non-flammable under ordinary conditions. The preferred polymers carbonize, but do not flame or smoke, in the presence of intense heat.

In a flame-resistant garment, the quantity of other fibers in the garment should be kept low enough that the garment remains substantially non-flammable or self-extinguishing. The optimum percentage will vary somewhat depending upon the polybenzazole polymer, the types of other fibers in the garment and the expected conditions of use. The flame-resistant garment preferably meets the following tests of flame-resistance: ASTM D-5903, ASTM D-4108-82, NFPA 1973 and/or NFPA 1971.

In cut-resistant garments, the quantity of polybenzazole fiber should be high enough to provide a garment with cut-resistance substantially greater than the cut resistance of garments made with conventional clothing fibers. The optimum percentage will vary somewhat depending upon the polybenzazole polymer, the types of other fibers in the garment, and the relative needs for cut resistance and comfort. Garments containing the most preferred polybenzazole polymers and conventional clothing fibers preferably contain at least about 10 weight percent cut-resistant fiber and more preferably at least about 20 weight percent. The garment may contain as much as 100 percent polybenzazole fiber. If the garment is tested for cut resistance as described in Boone, U.S. Pat. No. 4,864,852 (Sep. 12, 1989), which is incorporated herein by reference, then the cut-resistance of the garment is preferably at least equal to that of garments containing leather (about 2–3 cuts), more preferably at least equal to that of garments containing aramid (about 170 cuts) and most preferably greater than that of garments containing aramid fibers (at least about 250 cuts).

ILLUSTRATIVE EXAMPLES

The present invention is illustrated more fully by the following Examples. The Examples are for illustrative purposes only, and should not be taken as limiting the scope of either the Specification or the Claims. Unless stated otherwise, all parts and percentages are by weight.

EXAMPLE 1

Preparation of Continuous Filament PBO Yarn and Gloves Made from It

A plurality of fibers are spun by conventional means from a dope containing about 14 weight percent rigid rod cis-polybenzoxazole polymer in polyphosphoric acid. The polymer has an intrinsic viscosity of between about 30 dL/g and about 40 dL/g as measured in methanesulfonic acid at about 30° C. The fibers have an average tensile strength of at least about 550,000 psi and an average thickness of about 10 μm to about 25 μm.

The fibers are formed into a continuous filament yarn having an average thickness of about 1100 denier. Light weight knitting oil is applied to the tow as a lubricant. The yarn is twisted with 1.5 turns per inch on a Leesona ring twister having 5-inch rings. The twisted yarn is knit to form a string knit glove using a Shimi Shiki flat bed knitting machine designed to knit aramid gloves. The polybenzoxazole yarn is too cut-resistant for the cutter used to separate the fingers of the glove from the palm of the glove, so that the cutting must be done by hand. The resulting glove is highly resistant to cutting and slashing.

The cut-resistance of the glove is tested using a Betatec TM cut tester. A new razor blade weighted with 135 grams cuts across a section of the fabric at a measured rate of 40 slices per minute until the fabric is cut through (measured by contact with an electrical conductor. The razor is replaced after each trial The results are normalized for the weight fiber in the fabric. The results of the test are reported in Table 1. The experiment is repeated using a similar glove made from Kevlar TM 29 aramid fiber and a glove made from Spectra TM 900 polyethylene fiber, for comparative purposes

TABLE 1

| Polymer | PBO | Aramid* | Gel-Spun Polyethylene* |
|---|---|---|---|
| Denier | 1100 | 1100 | 1300 |
| Glove Weight (oz.) | 1.0 | 0.7 | 1.2 |
| No. of Slices | 625 | 178 | 172 |
| No. of Slices per oz. Glove | 625 | 254 | 143 |
| Gm. to cut | 84,375 | 24,030 | 23,220 |
| Gm. to cut per oz. Glove | 84,375 | 28,836 | 19,342 |

*not an example of the invention.

EXAMPLE 2

Preparation of Composite Fibers and Gloves Made from Them

A twisted yarn is made as described in Example 1. The yarn is incorporated into a three double wrapped composite fibers having the components described in Table 2. Each fiber is woven to make a string knit glove, as described in Example 1. Each glove is highly cut-resistant.

TABLE 2

| Glove | Element | Material | Thickness |
|---|---|---|---|
| 1 | Core-1 | Stainless Steel Wire | 0.0035 in. |
| | Core-2 | Polybenzoxazole | 1000 Denier |
| | Wrap-1 | Dyed Polyester | 500 Denier |
| | Wrap-2 | Dyed Polyester | 500 Denier |
| 2 | Core-1 | Stainless Steel Wire | 0.0035 in. |
| | Core-2 | Polybenzoxazole | 1000 Denier |
| | Wrap-1 | Polybenzoxazole | 1000 Denier |
| | Wrap-2 | Dyed Nylon | 500 Denier |
| 3 | Core-1 | Glass | 75-1-0* |
| | Core-2 | Polybenzoxazole | 1000 Denier |
| | Wrap-1 | Polyester | 500 Denier |
| | Wrap-2 | Polyester | 500 Denier |

*expressed as 100 yds per lb. - ply - twist

We claim:

1. A protective cut-resistant garment that comprises a plurality of fibers that contain a liquid-crystalline polybenzoxazole or polybenzothiazole polymer, selected such that the garment is cut-resistant.

2. The garment of claim 1 wherein the polybenzazole polymer contains a plurality of repeating units which are predominantly AB-mer units represented the Formula:

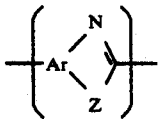

wherein:

Each Ar represents an aromatic group;

Each Z is independently an oxygen or a sulfur atom; and

The nitrogen atom and the Z moiety in each azole ring are bonded to adjacent carbon atoms in the aromatic group, such that a five-membered azole ring fused with the aromatic group is formed.

3. The garment of claim 2 wherein each Ar in the AB-mer units is a 1,3,4-phenylene moiety or an analog thereof.

4. The garment of claim 2 wherein each AB-mer unit is independently represented by one of the Formulae:

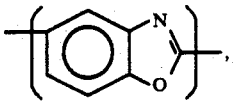

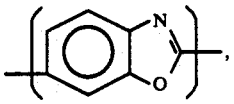

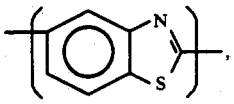

and

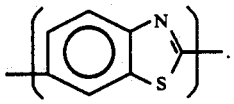

5. The garment of claim 1 wherein the polybenzazole polymer contains a plurality of mer units that are predominantly AA/BB-mer units represented in Formula 1(b)

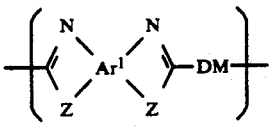

wherein:

Each $Ar^1$ represents an aromatic group;

Each Z is independently an oxygen or a sulfur atom;

Each DM is independently a bond or a divalent organic moiety that does not interfere with the synthesis, fabrication or use of the polymer;

The nitrogen atom and the Z moiety in each azole ring are bonded to adjacent carbon atoms in the aromatic group, such that a five-membered azole ring fused with the aromatic group is formed; and The azole rings in AA/BB-mer units may be in cis-or trans-position with respect to each other.

6. The garment of claim 5 wherein each DM in the AA/BB-mer units is an aromatic group, and each aromatic group in the AA/BB-mer units contains no more than about 12 carbon atoms.

7. The garment of claim 5 wherein each AA/BB-mer units is independently represented by one of the Formulae:

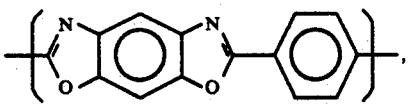

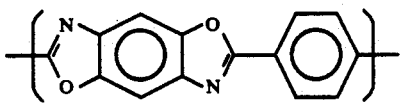

or

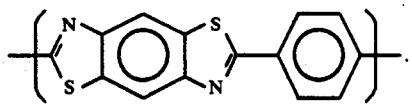

8. The garment of claim 1 wherein the garment consists essentially of yarn containing polybenzazole fiber.

9. The garment of claim 1 wherein the garment comprises polybenzazole fiber woven with a second fiber.

10. The garment of claim 9 wherein the second fiber is cotton, polyester, nylon or rayon.

11. The garment of claim 1 wherein the polybenzazole fiber is part of a composite fiber.

12. The garment of claim 11 wherein the polybenzazole fiber is part of the wrap portion of the composite fiber.

13. The garment of claim 11 wherein the polybenzazole fiber is part of the core portion of the composite fiber.

14. The garment of claim 13 wherein the core also contains a second fiber which is an aramid fiber, a gel-spun polyethylene fiber, a glass fiber or a steel fiber.

15. The garment of claim 13 wherein the wrap contains one or more fibers which are each independently cotton, polyester, nylon or rayon fibers.

16. The garment of claim 1 which meets the ASTM D-5903 test for flame retardency.

17. The garment of claim 1 wherein the polybenzazole fiber has an average tensile strength of at least about 1.75 GPa.

18. The garment of claim 1 which is a glove, sock, chap, vest, overall or pressure suit.

19. A composite fiber comprising:

(1) a core containing one or more essentially parallel cut-resistant fibers; and (2) at least one wrapping fiber wrapped around said core, wherein either the wrapping fiber or the core contains a polybenzoxazole or polybenzothiazole fiber.

20. The composite fiber of claim 19 wherein the core contains a polybenzoxazole or polybenzothiazole fiber.

21. The composite fiber of claim 20 wherein the core further contains an aramid fiber, a gel-spun polyethylene fiber, a glass fiber or a steel fiber.

22. The composite fiber of claim 20 wherein the wrap contains cotton, polyester, nylon or rayon fibers.

23. The composite fiber of claim 19 wherein the wrap contains a polybenzoxazole or polybenzothiazole fiber.

24. The composite fiber of claim 19 wherein the proportion of wrap fiber in the composite fiber is between about 30 weight percent and about 95 weight percent.

25. The composite fiber of claim 19 wherein polybenzoxazole or polybenzothiazole fibers within the composite fiber contain a polybenzoxazole or polybenzothiazole polymer that contains repeating units selected from the group consisting of:

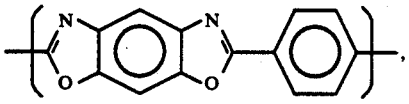

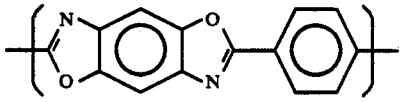

or

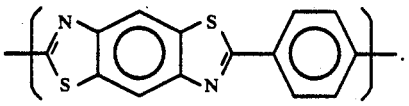

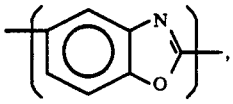

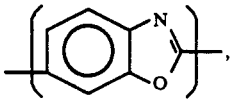

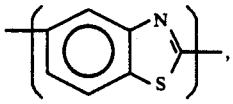

and

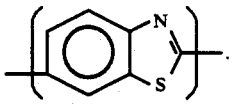

26. A method to protect a person or object from sharp objects, comprising the step of interposing a fabric that comprises a plurality of fibers that contain a liquid-crystalline polybenzoxazole or polybenzothiazole polymer, selected such that the fabric is cut-resistant, between the person or object to be protected and the sharp object.

27. The method of claim 26 wherein the fibers contain a polybenzoxazole or polybenzothiazole polymer that forms liquid crystalline domains when dissolved in a solvent acid at concentrations of 14 weight percent.

28. The method of claim 26 wherein the fibers contain a polybenzoxazole or polybenzothiazole polymer that contains repeating units selected from the group consisting of:

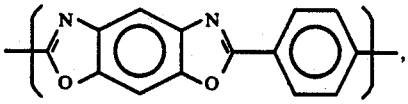

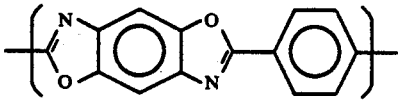

or

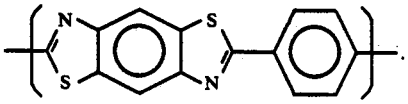

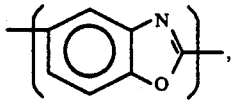

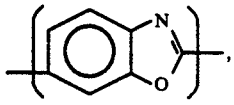

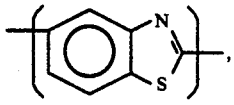

and

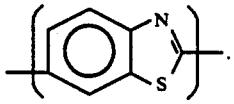

29. The method of claim 26 wherein the fabric consists essentially of fibers that contain polybenzoxazole or polybenzothiazole polymer.

30. The method of claim 26 wherein the fabric comprises polybenzazole fiber woven with a second fiber.

31. The method of claim 26 wherein the fabric contains a composite fiber having a core and a wrapped portion.

32. The method of claim 26 wherein the fabric meets the ASTM D-b 5903 test for flame retardancy and is interposed between a person or object and a flame.

33. The method of claim 26 wherein the fabric can withstand at least 170 cuts from a Betatec TM cut testing apparatus with a new razor blade that is weighted with 135 g.

* * * * *